US010925364B2

(12) United States Patent
Fernandez

(10) Patent No.: US 10,925,364 B2
(45) Date of Patent: Feb. 23, 2021

(54) BAG FOR MULTIPLE PAIRS OF SHOES

(71) Applicant: Anthony M. Fernandez, Winter Springs, FL (US)

(72) Inventor: Anthony M. Fernandez, Winter Springs, FL (US)

(73) Assignee: Sole Premise LLC, Winter Springs, FL (US)

( * ) Notice: Subject to any disclaimer, the term of this patent is extended or adjusted under 35 U.S.C. 154(b) by 258 days.

(21) Appl. No.: 15/860,752

(22) Filed: Jan. 3, 2018

(65) Prior Publication Data

US 2018/0125186 A1 May 10, 2018

Related U.S. Application Data

(60) Provisional application No. 62/569,006, filed on Oct. 6, 2017.

(51) Int. Cl.

| | |
|---|---|
| ***A45C 3/02*** | (2006.01) |
| ***A45C 3/12*** | (2006.01) |
| ***A45C 3/04*** | (2006.01) |
| ***A45C 13/10*** | (2006.01) |
| ***A45F 3/02*** | (2006.01) |
| ***A45C 13/04*** | (2006.01) |
| ***A45C 13/02*** | (2006.01) |

(52) U.S. Cl.

CPC ..... *A45C 3/12* (2013.01); *A45C 13/02* (2013.01); *A45C 13/04* (2013.01); *A45C 13/103* (2013.01); *A45F 3/02* (2013.01); *A45C 2013/025* (2013.01)

(58) Field of Classification Search

CPC ..... A45C 13/02; A45C 3/12; A45C 13/04; A45C 13/103

USPC ..... 224/257, 653, 153

See application file for complete search history.

(56) References Cited

U.S. PATENT DOCUMENTS

| | | | | | |
|---|---|---|---|---|---|
| 2,394,332 | A * | 2/1946 | Salem | A45C 13/40 | 150/117 |
| 4,171,011 | A * | 10/1979 | Kopin | A45C 13/40 | 150/106 |
| 5,209,384 | A * | 5/1993 | Anderson | A45C 13/02 | 224/223 |
| 5,423,404 | A * | 6/1995 | Shaw | A45C 3/00 | 190/102 |
| 5,577,652 | A * | 11/1996 | Cooper | A45F 3/02 | 224/153 |
| 5,918,711 | A * | 7/1999 | Godshaw | A45C 13/02 | 190/107 |

(Continued)

*Primary Examiner* — Nathan J Newhouse
*Assistant Examiner* — Lester L Vanterpool
(74) *Attorney, Agent, or Firm* — John V. Stewart

(57) ABSTRACT

A shoe-carrying bag with front and back shoe holding sections pivotally attached to a base. The front and back sections each have multiple shoe-carrying compartments that display the shoes behind see-through covers such as mesh fabric. A center section extends vertically from the base between the front and back sections. It has a compartment sized for a laptop computer. The front and back sections pivot apart from the center section into a horizontally opposed open position while the center section remains vertical. This displays all of the shoes in the front and back sections simultaneously while also providing unobstructed access to the center section. The base may have a further zippered compartment. Partitions between the shoe carrying compartments may be rigid or semi-rigid and non-releasable.

8 Claims, 3 Drawing Sheets

(56) References Cited

U.S. PATENT DOCUMENTS

| | | | | |
|---|---|---|---|---|
| 6,223,870 | B1 * | 5/2001 | Godshaw | A45C 7/0077<br>190/107 |
| 8,499,930 | B2 * | 8/2013 | Parness | A45C 3/004<br>206/288 |
| 2007/0000796 | A1 * | 1/2007 | Kameoka | A45C 3/12<br>206/278 |
| 2007/0267114 | A1 * | 11/2007 | Greiner | A45C 3/06<br>150/112 |
| 2016/0095400 | A1 * | 4/2016 | Lawton | A45C 3/12<br>206/292 |
| 2017/0055665 | A1 * | 3/2017 | Lanzisera | A45C 13/02 |

* cited by examiner

BAG FOR MULTIPLE PAIRS OF SHOES

CROSS REFERENCE TO RELATED APPLICATIONS

This application claims the benefit of U.S. provisional application 62/569,006, filed Oct. 6, 2017, which is incorporated herein by reference in its entirety.

FIELD

The invention relates to shoe carrying bags.

BACKGROUND

Shoes take a large amount of space in luggage, are inconveniently shaped for fitting with other items, and can be dirty. They can be individually bagged, but this does not protect the shoes from flattening, or protect other clothes from being crumpled by the shoes. Some carrying bags have movable partitions that can be configured to accommodate shoes, but at the expense of space in other partitions. Such movable partitions with hook and loop fasteners such as Velcro® are not stable enough to securely retain shoes against jostling of the bag.

Shoes are important to athletes as performance-optimizing sports apparel, and also as status symbols in sports and fashion. Sports shoes are customized specifically for the type of sport, the type of court surface, and to individual preferences. Therefore people often want to take multiple pairs of shoes with them on travel or to local events such as sports practice or competition.

DRAWINGS

DETAILED DESCRIPTION

Figure 1:
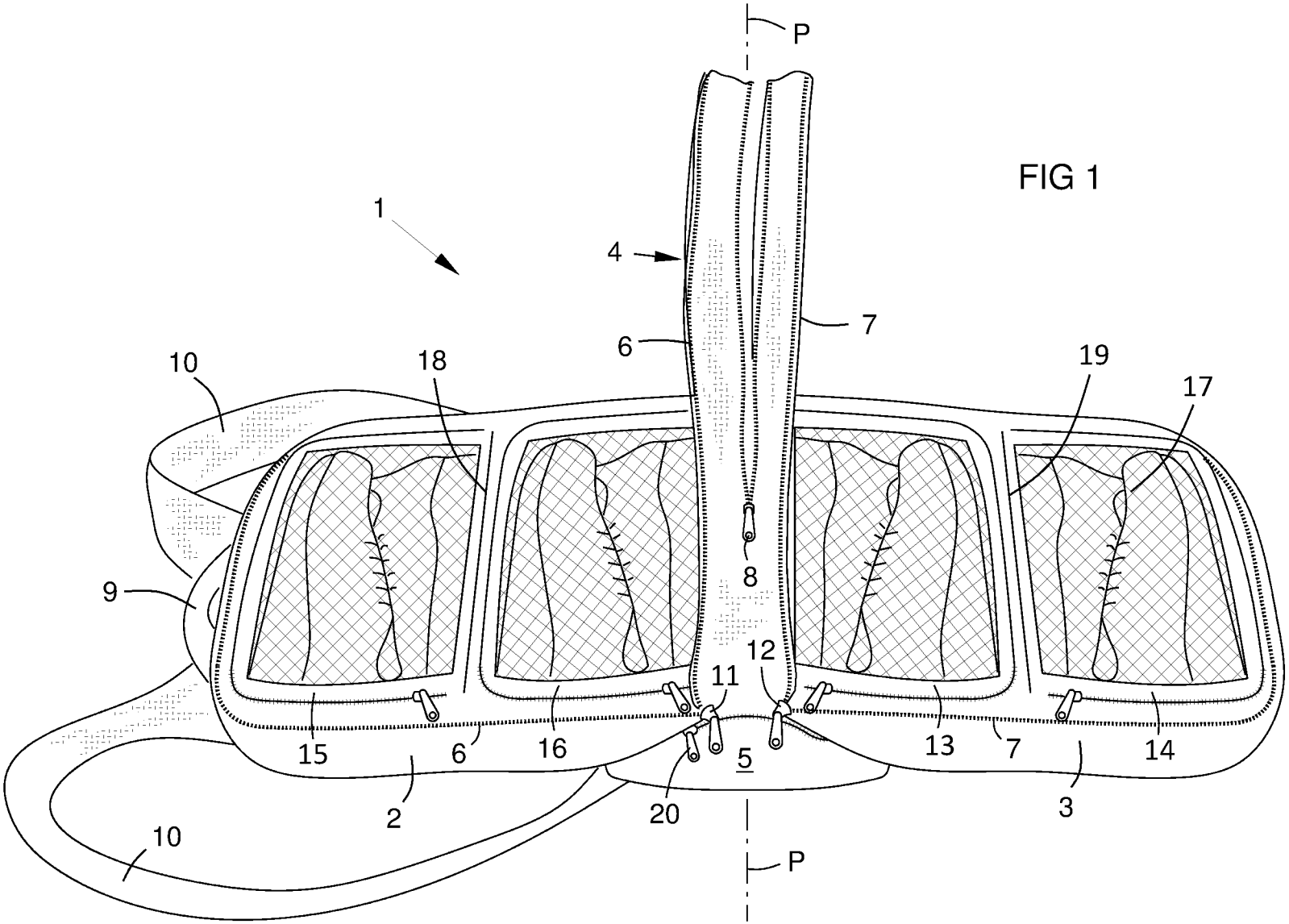
FIG. 1 is a side/top perspective view of a shoe carrying bag in accordance with aspects of the invention in an open configuration.

FIG. 1 shows a side/top perspective view of a shoe carrying bag 1 in accordance with aspects of the invention in an open position. It has a front section 3 and a back section 2 that open in a horizontally opposed or clamshell configuration as shown. The front and back sections may be largely mirror images of each other across a center vertical plane P or across a center vertically oriented compartment section 4. Sections 2, 3, and 4 are attached to a base 5, which may comprise an additional zippered compartment 20. The center section 4 may have a zipper 8 for top access to a compartment therein sized for a laptop computer. A handle 9 is attached to the top of the back section 2. A back strap 10 may be attached to a back side of the back section 2, which is also the back side of the bag 1. The open configuration shown provides simultaneous display of four shoe compartments 13, 14, 15, and 16. Multiple pairs of shoes 17 are simultaneously displayed behind a see-through cover of each shoe compartment, which may be made of fabric mesh. The center section 4 may remain vertical for access to a laptop or other accessory therein. Partitions 18, and 19 between the shoe compartments may be rigid or semi-rigid. These partitions may be permanent, rather than releasable, to avoid loosening.

Figure 2:
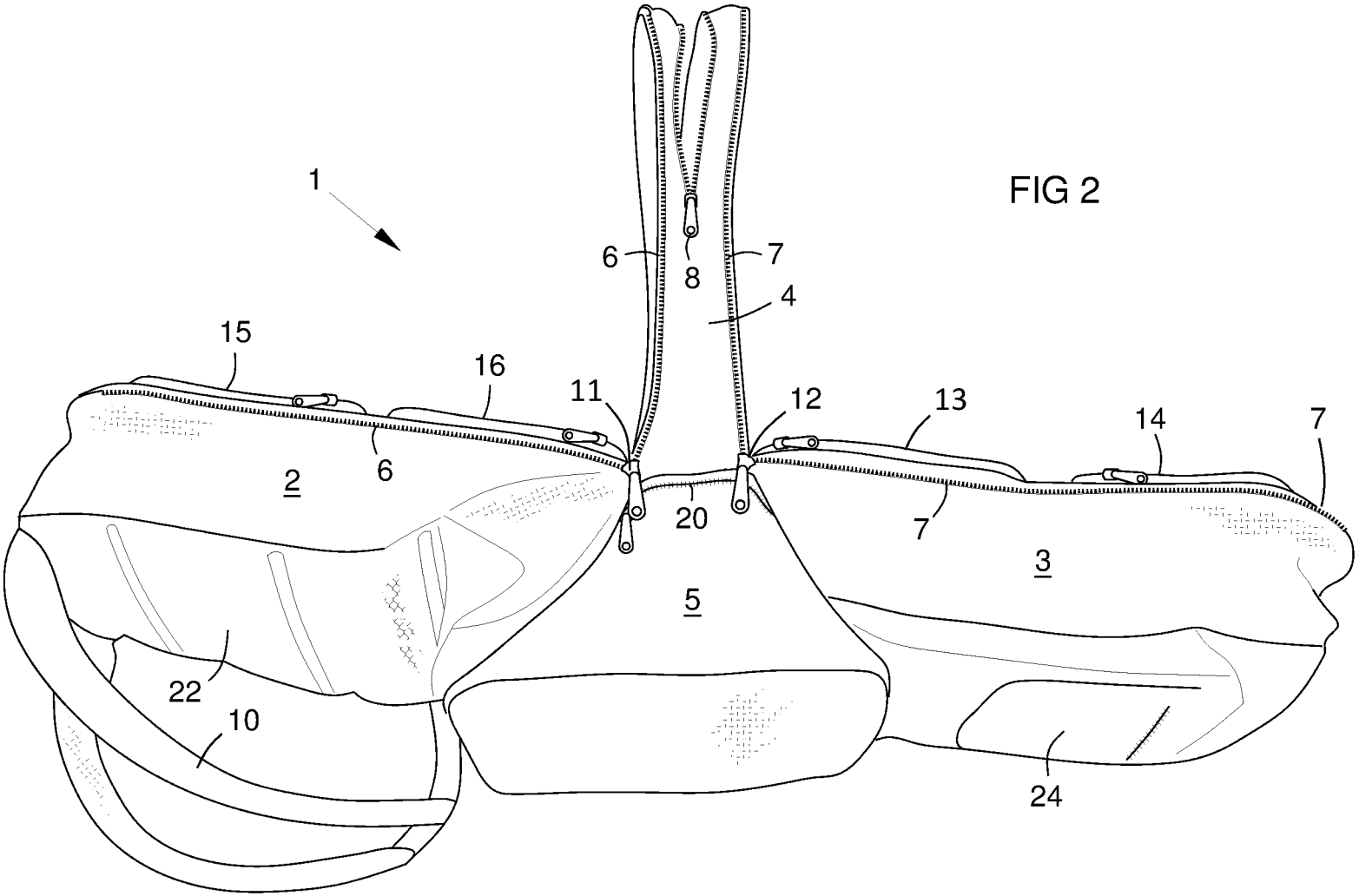
FIG. 2 is a side/bottom view of the shoe carrying bag of FIG. 1 in an open configuration.
Figure 3:
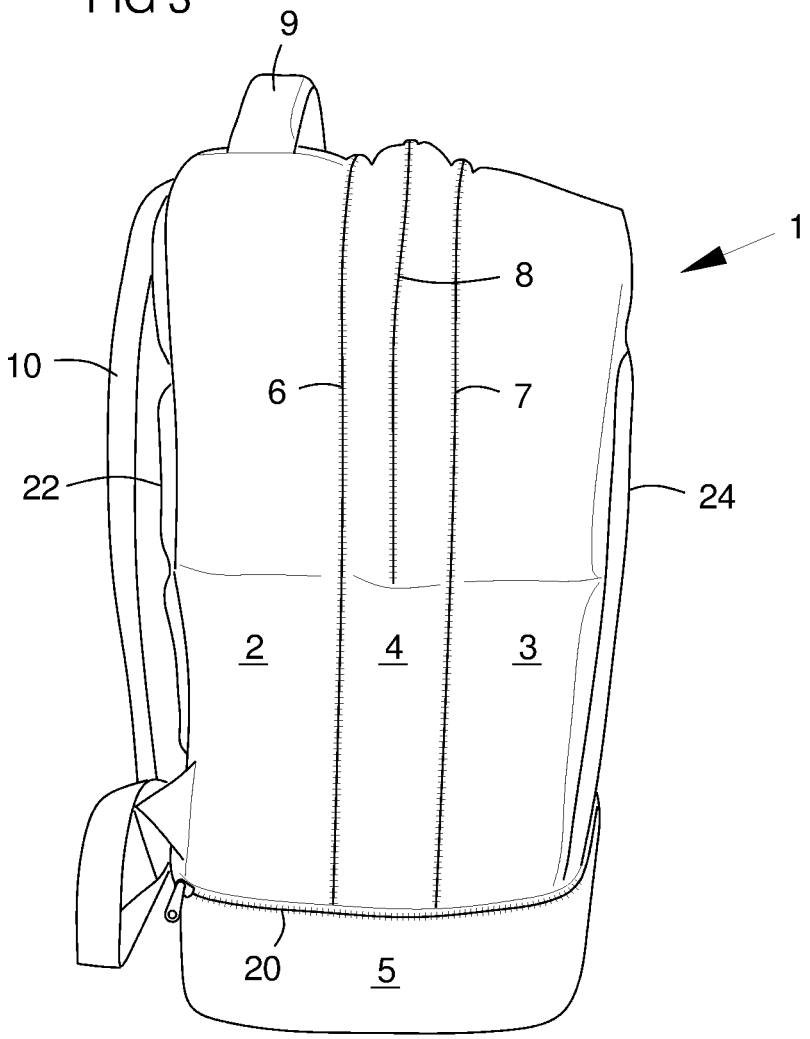
FIG. 3 is a side view of the shoe carrying bag of FIG. 1 in a closed configuration.

The bag may be made in a hard shell form (not shown) or in a fabric form as shown. The fabric form may include an internal frame such as a semi-rigid plastic frame that provides enough rigidity to hold the bag upright as shown in FIG. 3, and hold the center section vertical as shown in FIGS. 1 and 2. The back 22 of the bag is soft to conform to the back of a user for carrying via the back straps 10. The front of the bag may have one or more compartments 24 for wallet, papers, cellphone, or other items.

FIG. 2 shows a side/bottom view of the shoe carrying bag 1 in an open configuration. The back section 2 and front section 3 pivot apart from the center section 4 about effective hinge points 11 and 12. These hinge points may be created by hinge hardware on a hard shell embodiment (not shown) or by the bottom ends of the zipper openings 6 and 7 as shown. The zippers may be the non-separating type with teeth and sliders of strong metal. Reinforcement straps (not shown) may extend across the openings of the zippers 6 and 7 just above the bottom stops to reduce stress concentrations on the zippers when the sections 2 and 3 are open.

FIG. 3 shows a side view of the shoe carrying bag in a closed configuration.

When the front 2 and back 3 sections are open as in FIGS. 1 and 2, they provide simultaneous visible access to multiple shoe compartments in a horizontal layout for fast shoe selection, plus unobstructed access to the center section 4 for accessing a laptop or other accessory without needing to move any of the sections.

While various embodiments of the present invention have been shown and described herein, such embodiments are provided by way of example only. Variations, changes and substitutions may be made without departing from the invention herein. Accordingly, it is intended that the invention be limited only by the scope of the claims.

The invention claimed is:

1. A shoe carrying bag comprising:

front and back shoe holding sections releasibly attached to respective front and back sides of a vertical center section;

wherein the front and back sections open away from the center section in opposite directions into a horizontally opposed configuration while the center section remains vertical;

wherein each of the front and back sections comprises at least two shoe compartments, the shoe compartments being separated from each other by rigid or semi-rigid horizontal partitions within each of the front and back sections;

wherein each of the shoe compartments is sized to hold two shoes;

wherein a top side of the center section has a separable closure for inserting a laptop computer into a compartment in the center section.

2. The shoe carrying bag of claim 1, further comprising:

a base section with a zipper-accessible compartment, wherein the front and back sections are attached to the base section by effective hinge elements that allow the opening of the front and back sections in opposite directions from the center section and into said horizontally opposed configuration;

wherein the shoe carrying bag provides simultaneous visible access to the shoe compartments in the front and back sections and access to the center section; and wherein with none of the front, back, or center sections obscure another of the front, back, or center sections in the open position of the shoe carrying bag.

3. The shoe carrying bag of claim 1, wherein the horizontal partitions are fixed and non-releasable.

4. The shoe carrying bag of claim 1, further comprising:

a handle attached to a top side of the back section;

a back strap attached to a back side of the back section.

5. A shoe carrying bag, comprising:

front and back shoe-holding sections pivotally attached to a base;

multiple shoe compartments in each of the front and back sections;

a zippered see-through cover on each shoe compartment;

a center section of the shoe carrying bag that extends vertically from the base and comprises a zippered compartment therein sized for a laptop computer;

wherein the front and back sections pivot apart from the center section into a horizontally opposed open position with the front and back sections horizontal and the center section remaining vertical;

wherein in the open position the shoe carrying bag simultaneously displays all of the shoe compartments in the front and back sections while also providing unobstructed access to the center section;

wherein the base comprises a further zipper-accessible compartment; and wherein each of the front and back shoe holding sections comprise at least two shoe carrying compartments separated by a rigid or semi-rigid horizontal partition.

6. The shoe bag of claim 5, wherein the front and back shoe-holding sections comprise mirror images of each other about the center section.

7. The shoe bag of claim 5, wherein the front and back shoe-holding sections comprise mirror images of each other about a center vertical plane.

8. The shoe carrying bag of claim 5, further comprising:

a handle attached to a top side of the back section;

a back strap attached to a back side of the back section.

* * * * *